US008299878B2

(12) United States Patent
Pardo et al.

(10) Patent No.: US 8,299,878 B2
(45) Date of Patent: Oct. 30, 2012

(54) RF CIRCUIT SUBSTRATE COMPRISED OF GUIDE PORTIONS MADE OF PHOTOCURABLE LAYERS AND INCLUDING A PROTRUDING SURFACE FEATURES

(75) Inventors: Flavio Pardo, New Providence, NJ (US); Robert F. Fullowan, Berkeley Heights, NJ (US)

(73) Assignee: Alcatel Lucent, Paris (FR)

( * ) Notice: Subject to any disclaimer, the term of this patent is extended or adjusted under 35 U.S.C. 154(b) by 141 days.

(21) Appl. No.: 12/586,962

(22) Filed: Sep. 30, 2009

(65) Prior Publication Data

US 2011/0074528 A1 Mar. 31, 2011

(51) Int. Cl.
*H01P 3/18* (2006.01)

(52) U.S. Cl. ..... 333/239; 333/248

(58) Field of Classification Search ..... 333/239, 333/248

See application file for complete search history.

(56) References Cited

U.S. PATENT DOCUMENTS 3,157,847 A * 11/1964 Williams ..... 333/239
4,818,962 A * 4/1989 Molaine et al. ..... 333/239
2003/0090345 A1 * 5/2003 Cooray et al. ..... 333/239

* cited by examiner

*Primary Examiner* — Benny Lee
(74) *Attorney, Agent, or Firm* — McCormick, Paulding & Huber LLP

(57) ABSTRACT

A radio frequency circuit structure for transmitting radio signals includes a lower guide portion having a plurality of photocurable layers deposited on a substrate and an upper guide portion interfacing with the lower guide portion to define a guiding geometry. The upper guide portion may also include a plurality of photocurable layers deposited on a second substrate. A method for fabricating the radio frequency circuit structure includes depositing the plurality of photocurable layers on the substrate. A portion of each photocurable layer of the plurality of photocurable layers is exposed to ultraviolet light to form a latent image. The plurality of photocurable layers is developed to remove the portions not exposed to ultraviolet light to form a guide portion. The guide portion may be metalized and closed to form a guiding geometry. A lower guide portion may be closed by an upper guide portion formed in substantially the same manner as the lower guide portion.

8 Claims, 4 Drawing Sheets

RF CIRCUIT SUBSTRATE COMPRISED OF GUIDE PORTIONS MADE OF PHOTOCURABLE LAYERS AND INCLUDING A PROTRUDING SURFACE FEATURES

FIELD OF THE INVENTION

The present invention relates to radio frequency circuits and, more particularly, to high frequency radio frequency circuits.

BACKGROUND OF THE INVENTION

Radio frequency (RF) circuits include a variety of structures to transmit RF signals, for example, waveguides, resonant cavities, filters and the like. The RF circuit structures are used for transmitting signals at various frequencies of the electromagnetic spectrum, i.e., radio frequencies, radar frequencies and optical frequencies, by confining and guiding electromagnetic waves through the RF circuit. For example, conventional waveguides may include parallel plates or may be any rectangular or circular cross-sectional pipe structure that confines and guides electromagnetic waves between the first and second locations. As the frequency of the RF signal passed through the RF circuit increases, the size of the circuit structures required to guide and pass the signal decreases. For example, the required width of a waveguide may be as small as a few millimeters depending on the signal frequency, and may even be less than one millimeter (1 mm) to pass signals with extremely high frequencies. For signal frequencies approaching 80 GHz and beyond, circuit structure sizes fall into the micromachining regime. Fabricating micromachined circuit structures to accommodate these high frequency signals is difficult.

One known method for forming circuit structures is through high-precision computer numerical controlled (CNC) machining of metals. CNC machining of metals allows for the fabrication of high aspect ratio structures suitable for RF waveguides. However, manufacturing complexity of CNC machined circuit structures increases as structure size decreases due to the tight specifications required to form the necessary structure geometry, i.e. the hollow cavity of a resonant cavity. This increased complexity results in high relative manufacturing costs and reduces manufacturing yield.

Photolithography is a known technique for microfabrication, i.e. micromachining, of features within a thin film. Lithographic techniques are capable of producing features on a sub-micron to millimeter scale with high precision. However, while effective for formation of features of a thin film, photolithography does not allow for fabrication of the high aspect ratio structures necessary for RF circuit structures because the thin film of the lithographic process must be formed on a flat surface. Once the features are formed in the thin film, the topography of the features prevents further photolithographic layers from being formed thereon.

Therefore, there is a need to provide RF circuit structures for high frequency RF signals that overcome the manufacturing and cost deficiencies of the prior art.

SUMMARY OF THE INVENTION

According to the present invention, a radio frequency (RF) circuit structure includes a lower guide portion having a plurality of photocurable layers deposited on a substrate and an upper guide portion interfacing with the lower guide portion to define a guiding geometry for confining and guiding RF signals. The upper guide portion may also include a plurality of photocurable layers deposited on a second substrate.

A method for fabricating the circuit structure of the present invention includes depositing a plurality of photocurable layers on a substrate. A portion of each photocurable layer of the plurality of photocurable layers is exposed to ultraviolet light to form a latent image within the photocurable layer. The plurality of photocurable layers is developed to remove the non-exposed portions to form a lower guide portion. The lower guide portion is metalized and closed to form the guiding geometry.

The lower guide portion may be closed by an upper guide portion formed according to substantially the same method as the lower guide portion.

These and other objects, features and advantages of the present invention will become apparent in light of the following detailed description of non-limiting embodiments, with reference to the accompanying drawings, wherein like features throughout the figures are denoted by the same reference labels and may not be described in detail for all drawing figures in which they appear.

DETAILED DESCRIPTION OF A PREFERRED EMBODIMENT

Figure 1:
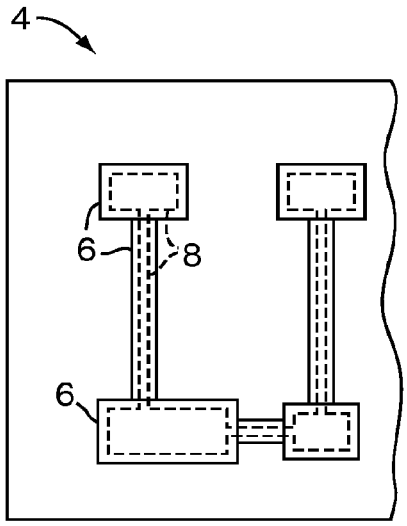
FIG. 1 is a top view of a radio frequency circuit according to an embodiment of the present invention.

Referring to FIG. 1, a radio frequency (RF) circuit 4 includes one or more RF circuit structures 6, each having a guiding geometry 8 for confining and guiding RF signals through the RF circuit 4.

Figure 2:
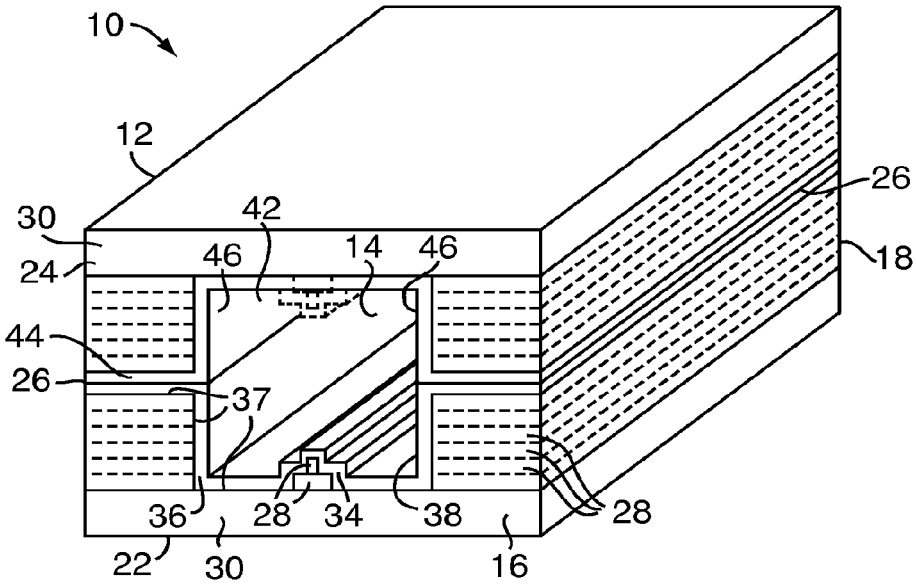
FIG. 2 is a perspective view of a waveguide according to an embodiment of the present invention.

Referring to FIG. 2, the RF circuit structure 6, shown in FIG. 1, may be a waveguide 10 used to transfer RF signals from a first location to a second, different location. The waveguide 10 includes a waveguide body 12, which defines the guiding geometry 8 (FIG. 1) that forms a waveguide channel 14. The waveguide channel 14 allows radio frequency (RF) signals to pass between a first end 16 and a second end 18 of the waveguide 10. The waveguide body 12 includes a lower guide portion 22 and an upper guide portion 24, which are joined at interfaces 26.

Figure 3:
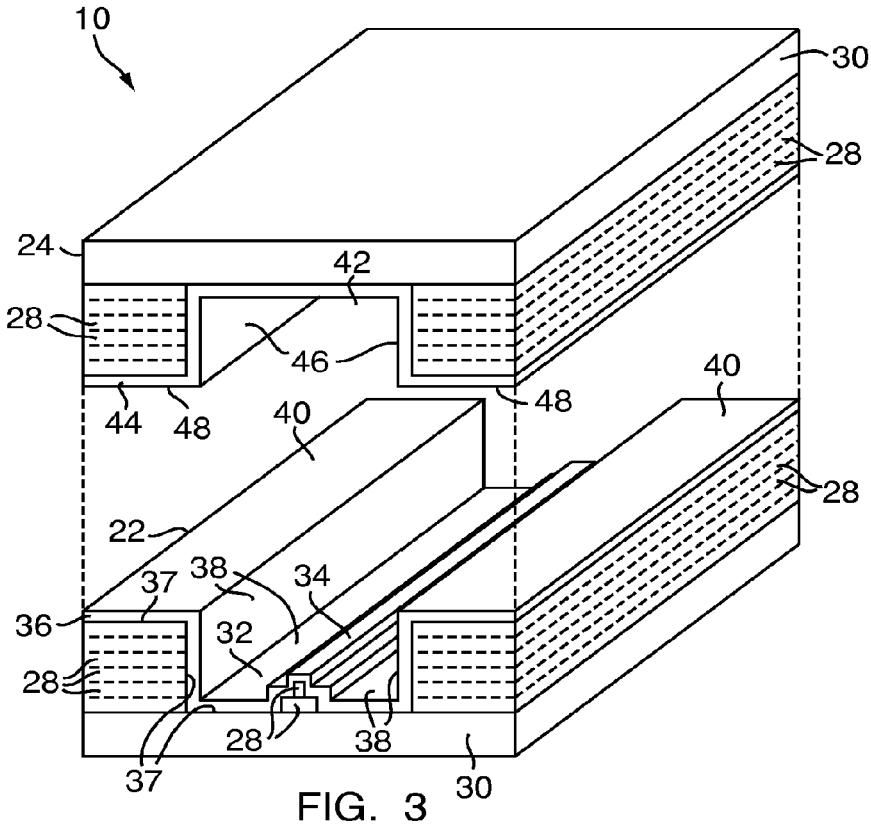
FIG. 3 is an exploded view of the waveguide of FIG. 2.

Referring to FIG. 3, the lower guide portion 22 includes a plurality of photocurable layers 28 disposed on a substrate 30. In a preferred embodiment, the substrate 30 is a glass or silicon wafer. However, substrate 30, as referred herein, can be any flat surface upon which photocurable layers 28 may be formed, for example, a printed circuit board. The photocurable layers 28 form sides for a lower channel portion 32 of the channel 14, shown in FIG. 2. The photocurable layers 28 may also form one or more internal surface features 34 of the waveguide 10 for improving transmission performance, for example, the photocurable layers 28 may form a ridge for increasing bandwidth of the waveguide 10. A first metallic layer 36 coats an upper surface 37 of the lower guide portion 22, forming lower channel surfaces 38 isolating the photocurable layers 28 from the channel 14. The first metallic layer 36 also forms lower interface surfaces 40 on the uppermost photocurable layer 28 for interfacing with the upper guide portion 24 at interfaces 26, shown in FIG. 2.

The upper guide portion 24 is of substantially the same construction as the lower guide portion 22, in an inverted configuration. As shown in FIG. 3, the upper guide portion 24 includes photocurable layers 28 disposed on the lower side of substrate 30, which is preferably a glass or silicon wafer. However, as discussed above, substrate 30 may be any flat surface upon which photocurable layers 28 can be formed. The photocurable layers 28 form sides for an upper channel portion 42 of the channel 14, shown in FIG. 2. A second metallic layer 44 coats the lower surface of the upper guide portion 24, forming upper channel surfaces 46 isolating the photocurable layers 28 from the channel 14. The second metallic layer 44 also forms upper interface surfaces 48 on the lowermost photocurable layer 28 for interfacing with the lower guide portion 22 at interfaces 26, shown in FIG. 2.

Although only the lower guide portion 22 is shown with the internal surface features 34 for improving performance of the waveguide 10 in FIGS. 2 and 3, it should be understood by those skilled in the art that the waveguide 10 may include internal surface features 34, such as ridge, on the lower guide portion 22, the upper guide portion 24 or both the lower and upper guide portions 22 and 24. The internal surface features 34 are formed from one or more photocurable layers 28 coated by the first or second metallic layers 36 and 44.

Figure 4:
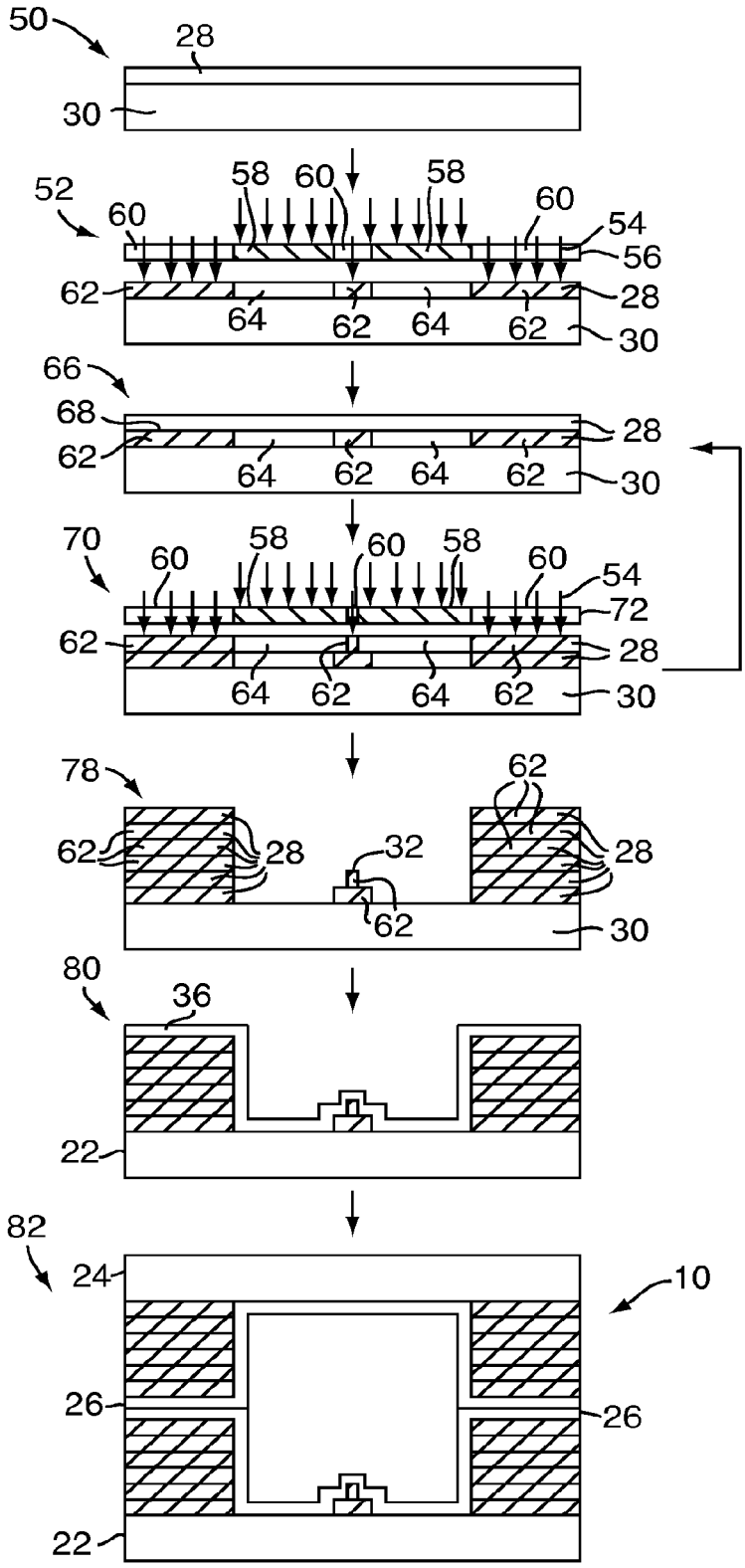
FIG. 4 is a process diagram for fabricating the waveguide of FIG. 2.

Referring to FIG. 4, a method of forming the waveguide 10 (FIGS. 2 and 3) using micro-lithographic techniques according to the present invention is shown. Although described in connection with waveguide 10 for simplicity, it should be understood by those skilled in the art that the same method may be used to form other RF circuit structures, as will be discussed below. Additionally, as shown in FIGS. 2 and 3, the lower guide portion 22 and the upper guide portion 24 may each be formed according to the process discussed below. For simplicity, the method steps will be discussed only in connection with the lower guide portion 22, however, the upper guide portion 24 may be formed according to the same process.

First, as shown in stage 50, photocurable layer 28 is formed on substrate 30 according to known photolithographic techniques. For instance, the photocurable layer 28 may be formed by spin-casting, wherein a photocurable material is deposited on the substrate 30 as a viscous liquid and the substrate 30 is spun spread the photocurable material over the substrate 30 at a substantially uniform thickness. The photocurable material is soft-baked to remove excess solvent present in the material and to partially solidify the photocurable material to form the photocurable layer 28 having a substantially uniform thickness.

Subsequently, as shown in stage 52, the photocurable layer 28 is exposed to ultra violet (UV) light 54 through a mask 56. The mask 56 covers the photocurable layer 28 and includes blocking regions 58 and passing regions 60. The blocking regions 58 prevent the UV light 54 from passing through the mask 56 to the photocurable layer 28. The passing regions 60 allow UV light 54 to pass through and reach the photocurable layer 28. Thus, when exposed to UV light 54 through the mask 56, the UV light 54 passes through only the passing regions 60 of the mask 56, which produces a latent image in the photocurable layer 28 defining exposed portions 62 from non-exposed portions 64. The photocurable layer 28 is then subjected to a post-exposure bake according to known photolithographic techniques to further solidify the photocurable layer 28.

Further, as shown in stage 66, another photocurable layer 28, i.e. a second layer, is formed on the first photocurable layer 28 having the latent image discussed above. Like the first photocurable layer 28, the second photocurable layer 28 may be formed according to known photolithographic techniques, for example, by spin-casting. Since the first photocurable layer 28 has a substantially uniform thickness, it also has a substantially flat top surface 68, upon which the second photocurable layer 28 may be formed. Like the first photocurable layer 28, the photocurable material forming the second photocurable layer 28 is soft-baked to remove excess solvent present in the material and to partially solidify the second photocurable layer 28 with a substantially uniform thickness.

As shown in stage 70, the second photocurable layer 28 is then exposed to UV light 54 through a second mask 72. The second mask 72 covers the photocurable layer 28 and includes blocking regions 58 and passing regions 60. The blocking regions 58 prevent the UV light 54 from passing through the second mask 72 to the photocurable layer 28. The passing regions 60 allow UV light 54 to pass through and reach the photocurable layer 28. Thus, when exposed to UV light 54 through the second mask 72, the UV light 54 passes through only the passing regions 60 of the second mask 72, which produces a latent image in the photocurable layer 28 defining exposed portions 62 from non-exposed portions 64. The photocurable layer 28 is then subjected to a post-exposure bake according to known photolithographic techniques to further solidify the second photocurable layer 28. As shown in FIG. 4, the second mask 72 may provide a different pattern of blocking and passing regions 58 and 60 than the first mask 56. Alternatively, the second mask 72 may provide the same pattern as the first mask 56, or the second photocurable layer 28 may simply be exposed to UV light 54 through the first mask 56, rather than the second mask 72, to provide a latent image that is substantially the same as that of the first photocurable layer 28.

Figure 5:
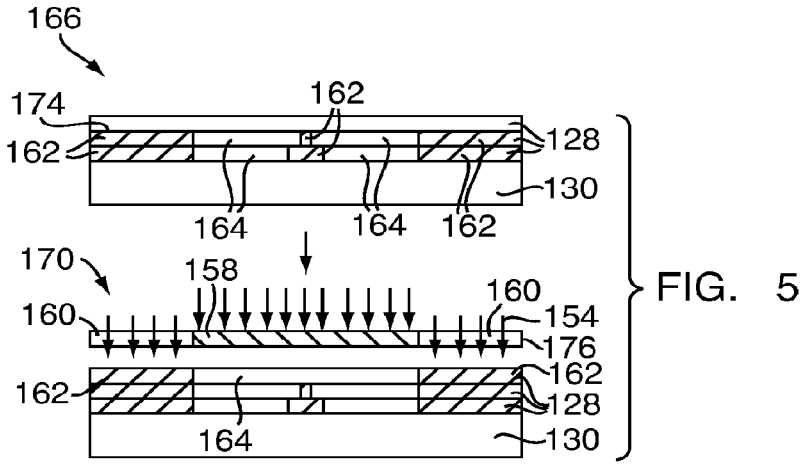
FIG. 5 is an alternate embodiment of a portion of the process of FIG. 4.

Stages 66 and 70 may be repeated to add additional photocurable layers 28 to the lower guide portion 22 until a desired depth and/or surface pattern for the lower guide portion 22 is achieved. For example, referring to FIG. 5, wherein like numerals represent like elements, another photocurable layer 128, i.e. a third layer, may be formed on the second photocurable layer 128 according to known photolithographic techniques in stage 166. Since the second photocurable layer 128 has a substantially uniform thickness, it has a substantially flat top surface 174, upon which the third photocurable layer 128 may be formed. Like the first and second photocurable layers 128, the photocurable material forming the third photocurable layer 128 is soft-baked to remove excess solvent present in the material and to partially solidify the third photocurable layer 128 with a substantially uniform thickness.

In stage 170, the third photocurable layer 128 is exposed to UV light 154 through a third mask 176. The third mask 176 covers the photocurable layer 128 and includes blocking region 158 and passing regions 160. The blocking regions 158 prevent the UV light 154 from passing through the third mask 176 to the photocurable layer 128. The passing regions 160 allow UV light 154 to pass through and reach the photocurable layer 128. Thus, when exposed to UV light 154 through the third mask 176, the UV light 154 passes through only the passing regions 160 of the third mask 176, which produces a latent image in the third photocurable layer 128 defining exposed portions 162 from non-exposed portion 164. The third photocurable layer 128 is then subjected to a post-exposure bake according to known photolithographic techniques to further solidify the third photocurable layer 128. Like the second mask 72 of FIG. 4, the third mask 176 may provide a different pattern of blocking and passing regions 158 and 160 or a pattern that is substantially the same as the first and second masks 56 and 72 of FIG. 4.

Referring back to FIG. 4, once the plurality of photocurable layers 28 has been formed on the substrate 30 to achieve the desired depth and/or internal surface features 32 of the lower guide portion 22, the portion is developed in stage 78. In stage 78, a developer (not shown), typically in liquid form, is applied to the lower guide portion 22. The developer dissolves and removes the non-exposed portions 64 from the lower guide portion 22. The exposed portions 62, which are insoluble in the developer due to their exposure to the UV light 54, remain on the substrate 30 to define the lower channel portion 32 of the waveguide 10, shown in FIG. 3. Depending upon the masks used in stages 52 and 70 for producing the latent images within the photocurable layers 28, one or more internal surface features 32 may also be formed by removal of the non-exposed portions 64 from the photocurable layers 28. Once development is complete and all of the non-exposed portions 64 have been removed from the lower guide portion 22, the lower guide portion 22 is hard baked according to known photolithographic techniques to ensure the photocurable layers 28 are solidified and to provide a durable protective layer for the lower guide portion 22. In stage 80, the lower guide portion 22 is metalized, for example, by evaporation of sputtering of metal, to form the first metallic layer 36. The metallic layer 36 may be formed from gold, aluminum, copper, silver or a similar metal, which is preferably selected to result in a low loss at the frequency of interest, i.e. the frequency of the signal to be passed through the waveguide 10.

As discussed above, the upper guide portion 24 may be fabricated according to substantially the same process described in stage 50 through stage 80 in connection with the lower guide portion 22. In stage 82, waveguide 10 is formed by attaching the lower waveguide portion 22 and the upper waveguide portion 24 to one another, forming interfaces 26. The lower and upper waveguide portions 22 and 24 may be attached by physical contact, for example, through clamps, or by other know connection means such as soldering or conductive epoxy.

Figure 6:
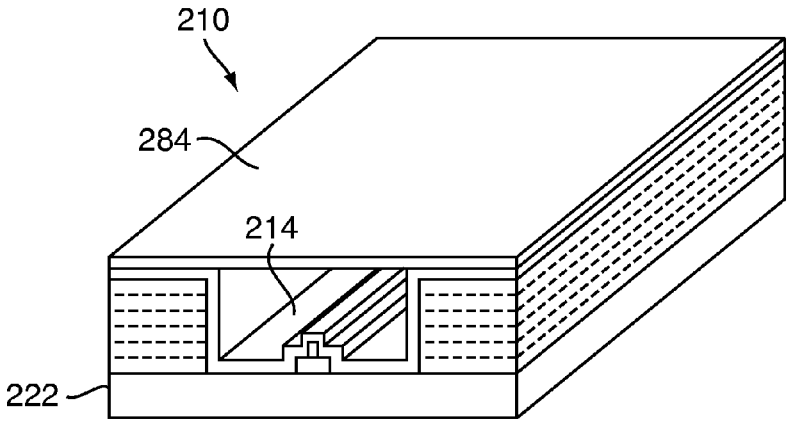
FIG. 6 is a perspective view of another embodiment of a waveguide according to the present invention.

Alternatively, in the embodiment shown in FIG. 6, the lower guide portion 222 may simply be closed by a metal plate 284, acting as the upper guide portion, to form the waveguide 210 having waveguide channel 214.

Figure 7:
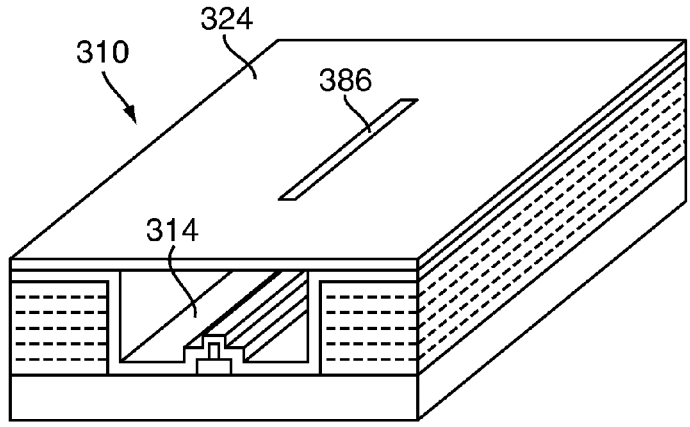
FIG. 7 is a perspective view of another embodiment of a RF circuit structure according to the present invention.

Referring to FIG. 7, in another embodiment, the upper guide portion 324 may include one or more moveable parts 386, i.e. microelectromechanical systems (MEMS), which can be moved into and out of the waveguide channel 314. The moveable part 386 provides the waveguide 310 with a tunable feature, for example, to fine tune the waveguide for a specific waveguide frequency, to provide a phase delay to the transmitted signal, to provide a filter or the like.

Figure 8:
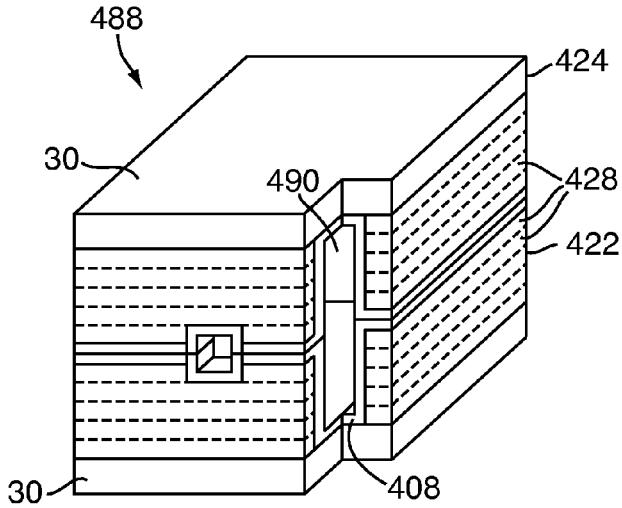
FIG. 8 is a partial cutaway perspective view of another embodiment of a RF circuit structure according to the present invention.

Referring to FIG. 8, in another embodiment of the present invention, the one or more RF circuit structures 6, shown in FIG. 1, may include a resonant cavity 488 used to isolate and attenuate RF signals of a specific frequency. The resonant cavity 488 includes a lower guide portion 422 and an upper guide portion 424 defining guiding geometry 408 that forms an internal cavity 490. The resonant cavity 488 may be formed from a plurality of photocurable layers 428 being deposited on substrates 30 according to substantially the same process discussed in connection with FIGS. 4 and 5.

As should be understood by those skilled in the art, the method according to the present invention may be used to fabricate a variety of known RF circuit structures 6 including waveguides 10, resonant cavities 488, filters (not shown) and other similar RF circuit structures 6. Additionally, as should also be understood by those skilled in the art, The RF circuit 4, shown in FIG. 1, may include multiple RF circuit structures 6 formed simultaneously on a single substrate simply by selecting appropriate UV masks during the microlithography process.

The present invention provides a method for fabricating RF circuit structures 6 with the high width to height aspect ratios necessary to transmit high frequency RF waves, particularly those approaching and exceeding 80 GHz. For example, the waveguide 10 may be formed with a channel width of approximately 1.8 mm and a channel height of approximately 0.7 mm to provide waveguide 10 with an aspect ratio of approximately two (2) to accommodate a DC RF wave with a frequency of approximately 90 GHz. The RF circuit structures 6, according to the present invention, operate in the same manner as known RF circuit structures, with signals being coupled into and out of the RF circuit using known transitions such as waveguide feeds, which generally launch energy into and sense energy from waveguides.

The method according to the present invention overcomes the deficiencies of prior art photolithographic techniques by performing a single development step of all of the photocurable layers 28 at one time. This allows each photocurable layer 28 to be formed on a flat surface, i.e. the previously formed photocurable layer 28, which eliminates the topography formed during prior art lithographic processes that prevents the formation of relatively thick lithographic structures. Accordingly, the present invention provides micro-lithographic fabrication of thick structures necessary for high frequency RF circuit structures 6.

Additionally, unlike CNC machined high frequency waveguides, which are expensive and difficult to manufacture, the present invention provides a method for low cost, high-precision and high-batch fabrication of high frequency RF circuit structures 6. Additionally, the method according to the present invention can be held to tighter dimensional specifications than CNC machined waveguides, resulting in higher performance RF circuit structures.

Although this invention has been shown and described with respect to the detailed embodiments thereof, it will be understood by those skilled in the art that various changes in form and detail thereof may be made without departing from the spirit and the scope of the invention. For example, although the photocurable layer has been described in the context of a negative photoresist where non-exposed material is removed during development, the methods described in the present invention may similarly be applied to a positive photoresist where material exposed to UV light is removed during development with the non-exposed material remaining to form the RF circuit structure.

What is claimed is:

1. A radio frequency circuit structure comprising:

a lower guide portion having a plurality of photocurable layers deposited on a substrate; and an upper guide portion interfacing with the lower guide portion to define a guiding geometry;

wherein at least one layer of the plurality of photocurable layers forms a protruding surface feature on the substrate.

2. The radio frequency circuit structure according to claim 1, wherein the upper guide portion includes a second plurality of photocurable layers deposited on a second substrate.

3. The radio frequency circuit structure according to claim 1, wherein the upper guide portion interfaces with the lower guide portion to form a waveguide.

4. The radio frequency circuit structure according to claim 1, wherein the guiding geometry is a channel extending from a first end to a second end of the radio frequency structure; and wherein the protruding surface feature is a ridge extending the length of the channel.

5. The radio frequency circuit structure according to claim 1, wherein the upper guide portion includes a second plurality of photocurable layers deposited on a second substrate; and wherein at least one photocurable layer of the second plurality of photocurable layers forms a second surface feature on the second substrate.

6. The radio frequency circuit structure according to claim 5, wherein the guiding geometry is a channel extending from a first end to a second end of the radio frequency structure; and wherein the second surface feature is a ridge extending the length of the channel.

7. A radio frequency circuit structure comprising:

a lower guide portion having a plurality of photocurable layers deposited on a substrate; and an upper guide portion interfacing with the lower guide portion to define a guiding geometry;

wherein the upper guide portion includes a moving part.

8. A radio frequency circuit structure comprising:

a lower guide portion having a plurality of photocurable layers deposited on a substrate; and an upper guide portion interfacing with the lower guide portion to define a guiding geometry;

wherein the upper guide portion is a metal plate.

* * * * *